US006698751B2

(12) United States Patent
Allen et al.

(10) Patent No.: US 6,698,751 B2
(45) Date of Patent: Mar. 2, 2004

(54) COMPACT STACKER FOR NOTES OF VARIOUS WIDTHS

(75) Inventors: Michael S. Allen, Cleveland Hts., OH (US); John A. Latkowski, Willoughby Hills, OH (US); Malcolm H. R. Bell, Weetwood Leeds (GB)

(73) Assignee: Money Controls, Inc., Eastlake, OH (US)

( * ) Notice: Subject to any disclaimer, the term of this patent is extended or adjusted under 35 U.S.C. 154(b) by 0 days.

(21) Appl. No.: 10/150,432

(22) Filed: May 20, 2002

(65) Prior Publication Data

US 2003/0214095 A1 Nov. 20, 2003

(51) Int. Cl.[7] ..... B65H 29/46
(52) U.S. Cl. ..... 271/180; 271/177; 271/181
(58) Field of Search ..... 271/177, 180, 271/181

(56) References Cited

U.S. PATENT DOCUMENTS

| | | | | | |
|---|---|---|---|---|---|
| 4,858,744 A | * | 8/1989 | Dolejs et al. | ..... | 194/206 |
| 5,641,157 A | * | 6/1997 | Mays et al. | ..... | 271/181 |
| 6,241,240 B1 | * | 6/2001 | Bukhman | ..... | 271/214 |

FOREIGN PATENT DOCUMENTS

| | | | | | |
|---|---|---|---|---|---|
| EP | 1096434 A | | 9/2000 | | |
| JP | 01271355 A | * | 10/1989 | ..... | B65H/29/46 |
| JP | 02295852 A | * | 12/1990 | ..... | B65H/31/10 |
| JP | 05310354 A | * | 11/1993 | ..... | B65H/29/46 |
| JP | 06156844 A | * | 6/1994 | ..... | B65H/29/34 |
| JP | 820021630 A | | 8/1996 | | |

* cited by examiner

*Primary Examiner*—Donald P. Walsh
*Assistant Examiner*—Matthew J. Kohner
(74) *Attorney, Agent, or Firm*—Renner, Kenner, Greive, Bobak, Taylor & Weber

(57) ABSTRACT

A note stacker for a currency validator includes a stationary punch and movable rails having slots therein adapted for receiving the currency tendered thereto. The stationary punch comprises a top plate surface of the housing maintaining drive motors and gears of the stacker itself. The top plate is curved to accommodate the natural deflection of the bill as it is being stacked, and is provided with a durable frictional material along lateral edges thereof to prevent the bill from sliding or otherwise moving upon the surface of the curved plate. A leading edge of the curved plate is provided with serrations or teeth which, in conjunction with a shutter fixed to the movable rails, serves to defeat strings or other retrieval elements.

16 Claims, 3 Drawing Sheets

COMPACT STACKER FOR NOTES OF VARIOUS WIDTHS

TECHNICAL FIELD

The invention herein resides in the art of currency validators or acceptors. More particularly, the invention relates to stackers for currency validators, such stackers being adapted to receive, stack and maintain currency or notes determined to be valid. More particularly, the invention relates to stackers for currency validators which are space efficient and capable of accommodating notes or currency of various widths.

BACKGROUND OF THE INVENTION

Currency validators or note acceptors are now widely know and used. Oftentimes, such currency validators are free standing, providing the opportunity to change paper currency into coins. Other currency validators are incorporated into vending machines and the like to aid in effecting transactions. There, a note or paper currency may be tendered for effecting a purchase. The currency validator determines the validity of the tendered paper and, if determined to be invalid, rejects the same and denies the transaction. Otherwise, if determined to be valid, the paper currency is escrowed until the transaction is completed and then the currency is transported to a stacker where it is maintained with other genuine currency or notes. Those skilled in the art will appreciate that the total system of a note acceptor includes a validation portion where paper tendered as currency is validated and/or rejected, and a stacker, which receives and stacks the valid currency so received.

Stackers require a certain amount of space. A first portion of the space is required for actually maintaining the bills or paper currency actually received as authentic. Other space is required for movement of the punch which typically characterizes such stackers. Those skilled in the art will appreciate that the punch of a stacker may be actuated by scissors, a screw, or any other of various means. Typically, the operative mechanism of a stacker employs on the order of 1.5 inches of dead space to effectuate the stacking motion. This is 1.5 inches of space unavailable for receiving and stacking currency and, in systems where space is at a premium, greatly reduces the number of bills that may be accommodated by the stacker. Such a situation increases the frequency of service calls to the currency validator and, accordingly, reduces the efficiency of its operation.

It is also known in the art that the physical size of paper currency often varies from country to country and among the various denominations in any particular country. Accordingly, the inlet slot, note path and receiving rails of note acceptors must typically be able to accommodate all widths of notes that might be tendered thereto. In order to accommodate such various widths of notes, the inlet slot of some currency validators is typically justified or registered at one edge thereof, requiring that the currency enter the validator flush with that side or edge. As a consequence, the punch of the associated stacker does not symmetrically engage the note, allowing the note to "walk" across the punch, often resulting in a skewed note being maintained within the stack. The result may often be a denigration of the integrity of the stack which may ultimately jam or otherwise incapacitate further operation of the currency validator.

In light of the foregoing, there is a need in the art for a compact stacker adapted to receive and stack notes or currency of various widths.

DISCLOSURE OF INVENTION

In view of the above, it is a first aspect of the invention to provide a stacker for currency validators which is of a compact nature.

Another aspect of the invention is the provision of a stacker for currency validators which is capable of accommodating notes of various widths.

Still a further aspect of the invention is the provision of a stacker for currency validators which employs a stationary "punch."

Yet a further aspect of the invention is the provision of a stacker for currency validators in which note receiving rails move through a stationary "punch."

Yet another aspect of the invention is the provision of a stacker for currency validators in which the stationary punch has an arched or radiused top surface for deflecting notes into the stack.

Still a further aspect of the invention is the provision of a stacker for currency validators in which the stationary punch is provided with frictional gripping edges along each side of the arched top surface for engaging and securing the note as it is added to the stack.

A still further aspect of the invention is the provision of a stacker for currency validators which is reliable and durable, easy to use, and conducive to manufacture with state of the art elements and techniques.

The foregoing and other aspects of the invention which will become apparent as the detailed description proceeds are achieved by a note stacker for a currency validator, comprising: first and second oppositely positioned rails, said rails being spaced apart to define a gap, said rails being reciprocatingly movable together and being adapted to receive a note therebetween; a fixed plate in registration with said gap on a first side of said note when said note is received between said rails; and a movable plate biased toward said rails from a second side of said note when said note is received between said rails.

Other aspects of the invention which will become apparent herein are attained by a note stacker for a currency validator, comprising: a fixed housing; a pair of rails having a gap therebetween, said pair of rails being reciprocatingly movable over said fixed housing to alternatingly receive a top portion of said fixed housing within said gap and release said top portion from said gap.

BRIEF DESCRIPTION OF THE DRAWINGS

For a complete understanding of the objects, techniques and structure of the invention, reference should be made to the following detailed description and accompanying drawings wherein.

BEST MODE FOR CARRYING OUT THE INVENTION

Figure 1:
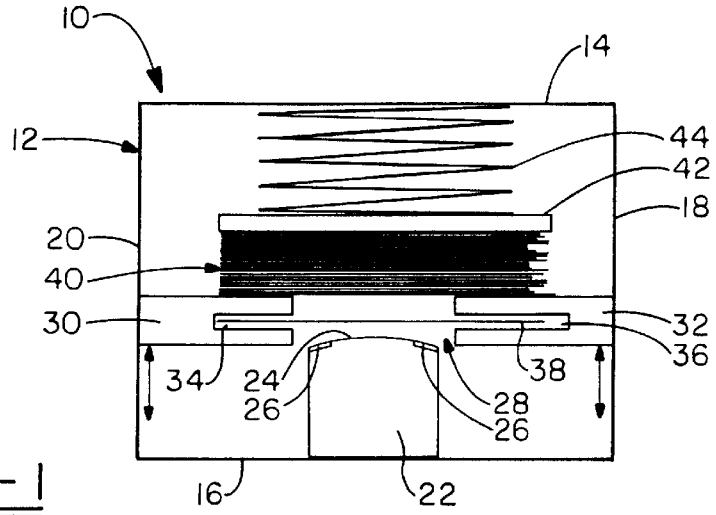
FIG. 1 is a schematic diagram of the note stacker made in accordance with the invention.
Figure 2:
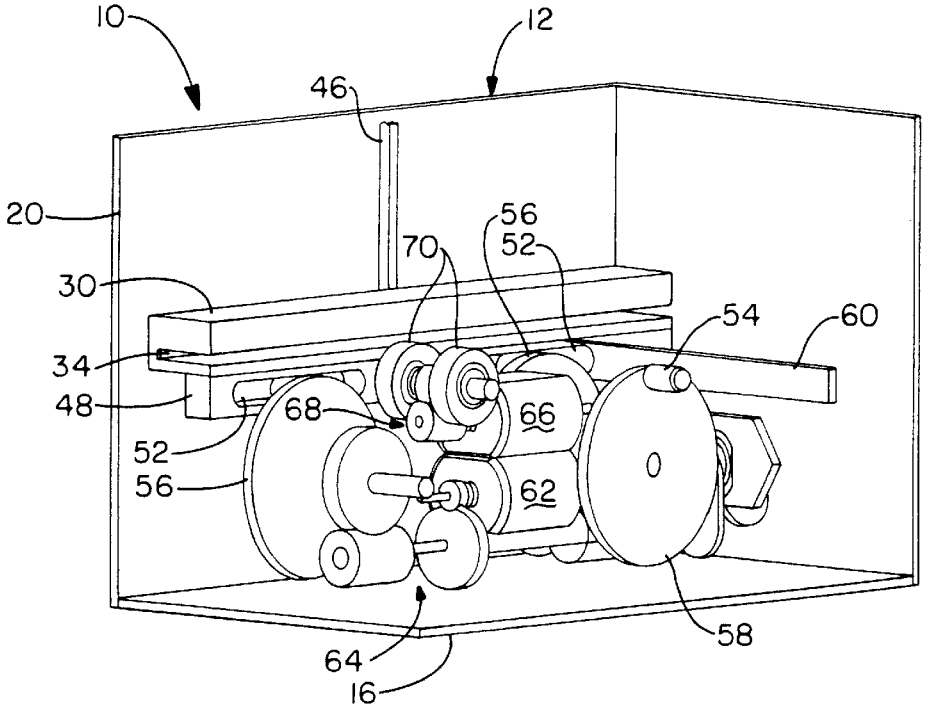
FIG. 2 is an illustrative view of a portion of the stacker of the invention, showing certain parts thereof removed to effect an appropriate view.

Referring now to the drawings and more particularly to FIG. 1, it can be seen that a note stacker made in accordance with the invention is designated generally by the numeral 10. The note stacker 10 is maintained within a housing 12 having a top 14, base 16, and sides 18, 20. Those skilled in the art will appreciate that the housing 12 may be of any suitable nature. Maintained within the housing 12 is a control housing 22 which, as will become apparent later herein, contains motors, drive wheels, gears and the like to effectuate the desired stacking of currency or bills received.

The control housing 22 is characterized by an arched or radiused top plate 24. While the radius of the top plate 24 may vary, it is contemplated to be on the order of 3.5–4.5 inches, and most preferably 4 inches. As will become apparent herein, the arched top plate 24 of the control housing 22 serves as a stationary punch for the note stacker 10. In that regard, the radius or arch of the plate 24 is such as to maintain the normal curvature of contact with the currency or bills being stacked by the stacker 10 during the stacking operation. Further, to assure that the bills maintain fixed contact with the plate 24 during the stacking operation, and to further assure that they do not walk or slide therefrom, inserts 26 of durable frictional material such as RTV or the like may be positioned longitudinally along the edges of the top plate 24, as shown. This frictional material engages the note or currency during the stacking operation and, in combination with the arched or curved surface thereof, assures that the note or currency does not walk or slide during the stacking operation. Accordingly, all bills or notes are consistently and uniformly stacked.

With continued reference to FIG. 1, it can be seen that the control housing 22 is positioned within a gap 28 defined between vertically movable side rails 30, 32. It is desired that the control housing 22 and top plate 24 be centrally positioned within the movable gap 28 to effectuate the "punching" or stacking of notes as will become apparent later herein. Moreover, it is preferred that the rail 30 have a minor slot 34 extending longitudinally therealong while the rail 32 have a major slot 36 so extending. As shown, the major slot 36 extends into the rail 28 a greater depth than the slot 34 into the rail 30. As shown, a note or paper currency 38 is received by the slots 34, 36 as placed therein by transport rollers to be discussed later herein. The notes 38 are justified against the wall of the slot 34, with the opposite edge of the note 38 being received within the slot 36, which is of sufficient depth as to accommodate any width of note intended to be received by the stacker 10. Accordingly, the resultant stack 40 of notes of various sizes is uniform along the left side of the stack as shown in FIG. 1, but is staggered on the right side, as a result of the various widths of notes received and maintained thereby. A stacking plate 42, generally of the size of the largest bill to be received by the stacker 10, is biased by a spring 44 interposed between the top 14 of the housing 12 and the plate 42 to maintain the bill stack 40 against the top surface of the movable rails 30, 32. The biasing by the spring 44 allows for the stack 40 to be maintained as the rails 30, 32 move during a stacking operation.

With reference now to FIGS. 2–5, it can be seen that the rail 30 is vertically movable upon a track 46 secured to wall 20. The track 46 may be of any suitable nature. It will also be appreciated that a similar track is provided upon the wall 18 in association with the rail 32 for such vertical movement. The rails 30, 32 are provided with support blocks 48, 50 (FIGS. 2 and 5) having forward and rearward slots 52 therein for receipt of pins 54 to be driven by drive wheels 56, 58 to effect the reciprocating upward and downward movement thereof. The support blocks 48, 50 are interconnected by a cross member 60 to maintain appropriate space and unity of operation. Such simultaneous movement of rails 30, 32 is further effected by the simultaneous driving of such wheels by a common motor 62 through appropriate fore and aft gear drives 64. Of course, the motor 66 is preferably a reversible motor, and may be a servo or stepper motor, as desired.

Figure 3:
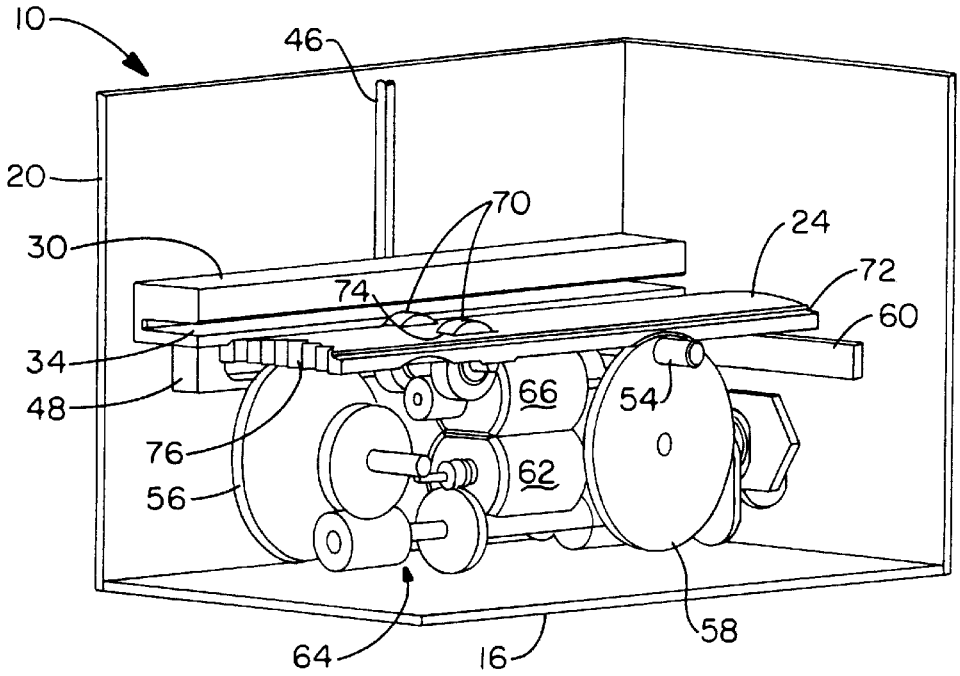
FIG. 3 is the illustrative view of FIG. 2, showing the stationary punch and transport wheels present.
Figure 4:
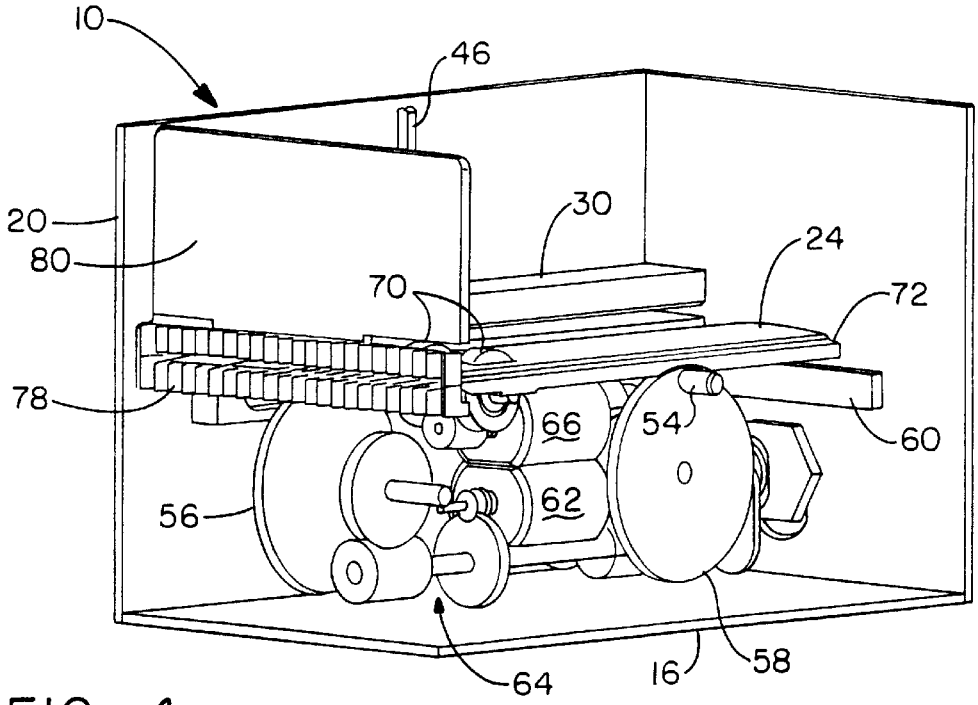
FIG. 4 is the illustrative view of FIG. 3 with the shutter and transition teeth present.
Figure 5:
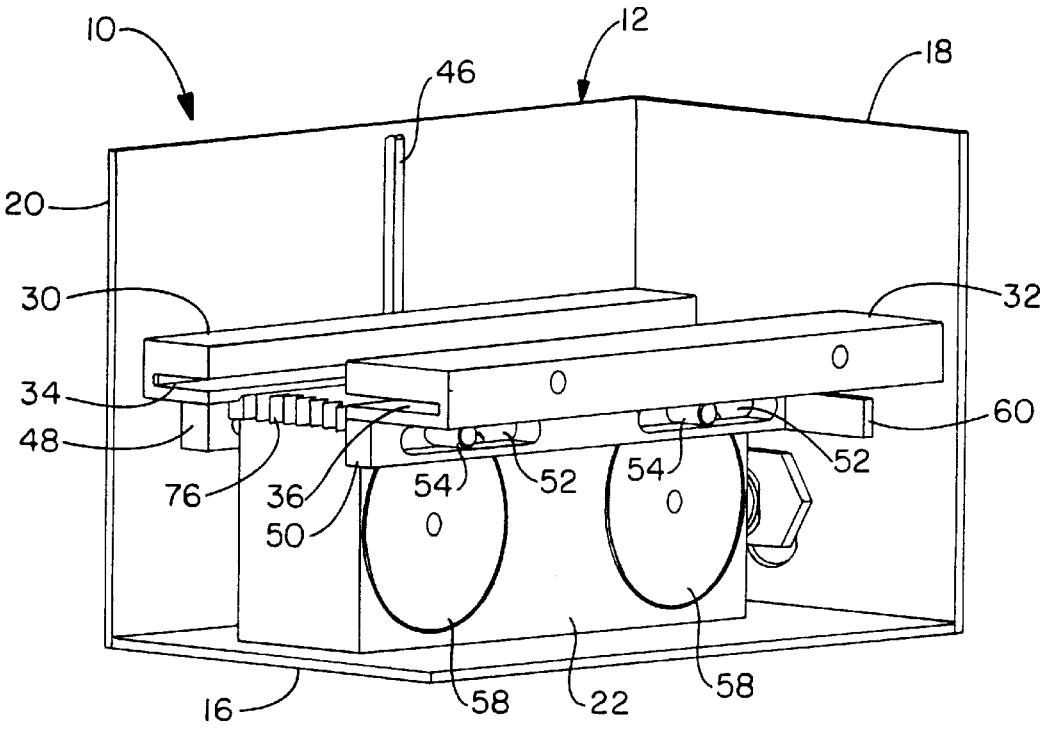
FIG. 5 illustrates the stacker of the invention with the control housing and both movable rails present.

As best shown in FIGS. 3 and 4, a second reversible motor 66 is provided with a gear drive 68 to effectuate rotation of transport rollers 70 passing through appropriate slots 74 in arched top plate 24. As will be appreciated by those skilled in the art, the transport rollers 70 move a bill or piece of currency authenticated by the validator through the slots 34, 36 of the rails 30, 32. The drive or transport rollers 70 may work against idler rollers (not shown) in somewhat common fashion to effectuate the necessary bite to achieve the desired transport.

As further shown in FIG. 3 the arched top plate 24 is characterized by formed edges 72 to receive durable frictional material inserts 26, shown in FIG. 1. Any suitable material such as RTV or the like may be placed into the machined edge portions 72 for the desired purpose. Further, the front or leading edge of the plate 24 may be characterized by teeth or serrations 76 to assist in defeating "stringing" mechanisms by those who might seek to retrieve their currency once it has been validated and accepted. The teeth or serrations 76 operate in conjunction with a shutter or gate 80 as shown in FIG. 4 to defeat the attachment of any "stringing" type element that might otherwise be attached to the currency being validated. In a preferred embodiment of the invention, the shutter or gate 80 is connected to and movable with the rails 30, 32 at front edges thereof to pass in proximity to the teeth or serrations 76 of the top plate 24 to define any retrieval path across the teeth or serrations 76 during the stacking operation, thus assuring that any stringing mechanism is torn or broken if retrieval is attempted.

Also shown in FIG. 4 are teeth or serrations 78 which are provided as a part of the housing 12 to interface with the validator or acceptor with which the stacker 10 is employed. The teeth or serrations 78 mate with corresponding teeth or serrations on the validator or acceptor to assure a smooth transition therebetween.

In use, a note or bill is transported from the validating portion of a note acceptor to the stacker 10 and into the slots 34, 36 of the side rails 30, 32. The motor 66 operates the transport rollers 70 to position the note so received immediately above the arched top plate 24 of the control housing 22. The bill is justified against the inside edge of the slot 34, with the slot 36 accommodating the opposite edge of the bill or note 38, of whatever acceptable width it might be. Once so received, operation of the motor 66 is terminated and operation of the motor 62 commenced. At this time, the wheels 56, 58 rotate such that the associated pins 54 operate within the slots 52 of the rail support blocks 48, 50 to move the rails 30, 32 and the note stack 40 downwardly such that the gap 28 having the note 38 therein passes over the top plate 24, with the top plate 24 making contacting engagement with the note 38. The curvature of the top plate 24 is preferably the natural curvature of the note 28 as it is drawn out of slots 34, 36 such that no acute bending or deflection of the note 38 is experienced. The note 38 is held upon the surface of the top plate 24 by the frictional strips 36 presented along the edges thereof. The stroke of rails 30, 32 is sufficient for the side edges of the note 38 to be fully extracted from the slots 34, 36 and to pass into the stack 40 in a left-justified manner. Once that travel has been made, operation of the motor 62 reverses and the rails return to their static position as generally shown in FIG. 1, awaiting receipt of the next bill.

As can be seen, the punch plate 24 is stationary, making no movement whatsoever during the stacking operation. Accordingly significant space savings is realized. The top of the punch may be arched or curved to the normal deflection arch of the paper currency to be stacked, and the slots 34, 36 of the moving rails 30, 32 are justified to one side (in alignment with a corresponding edge of the inlet slot to the validator) and are adapted to accommodate notes of various widths. The note stacker 10 in the housing 12 may be of a cassette nature such that the entire housing 12 and the components and cash therein may be simply replaced with an empty stacker 10 and housing 12 during routine servicing. Alternatively, the housing 12 may be provided with a door which may be opened such that the stack 40 of currency may be retrieved on site, or the housing 12 may be removable for such purpose.

Thus it can be seen that the objects of the invention have been satisfied by the structure presented above. While in accordance with the patent statutes only the best mode and preferred embodiment of the invention has been presented and described in detail, the invention is not limited thereto or thereby. Accordingly, for an appreciation of the true scope and breadth of the invention reference should be made to the following claims.

What is claimed is:

1. A note stacker for a currency validator, comprising:

first and second oppositely positioned rails, said rails being spaced apart to define a gap, said rails being reciprocatingly movable together and being adapted to receive a note therebetween;

a fixed plate in registration with said gap on a first side of said note when said note is received between said rails;

a movable plate biased toward said rails from a second side of said note when said note is received between said rails; and wherein said gap reciprocatingly moves as said rails reciprocatingly move, said gap receiving said fixed plate during said reciprocating movement, and each of said first and second rails has a slot therein for receiving said note, said slot of said second rail being deeper than said slot of said first rail.

2. The note stacker according to claim 1, wherein said fixed plate is arched.

3. The note stacker according to claim 2, wherein said fixed plate has frictional strips along longitudinally extending edges thereof.

4. The note stacker according to claim 3, wherein said fixed plate has transport wheels passing therethrough for transporting said note along said slots of said rails.

5. The note stacker according to claim 4, wherein said fixed plate comprises the top of a control housing maintaining therein a first motor for reciprocatingly moving said rails, and a second motor for activating said transport wheels.

6. The note stacker according to claim 5, wherein said rails reciprocatingly move upon respective tracks.

7. The note stacker according to claim 6, wherein said first motor drives wheels pinned to said rails for said reciprocating movement.

8. The note stacker according to claim 1, wherein said movable plate maintains a stack of notes against a first side of said rails, and said fixed plate urges said note received between said first and second rails into said stack upon reciprocating movement of said gap.

9. A note stacker for a currency validator, comprising:

a fixed housing; and a pair of rails having a gap therebetween, said pair of rails being reciprocatingly moveable over said fixed housing to alternatingly receive a top portion of said fixed housing within said gap and release said top portion from said gap; and wherein said fixed housing has a top plate in juxtaposition to a movable plate, said movable plate being biased toward said top plate, and each rail of said pair of rails has a slot therein for receipt of a note, said slot of one of said rails being deeper than said slot of the other of said rails.

10. The note stacker according to claim 9, wherein said top plate is radiused and has longitudinal side edges of frictional material.

11. The note stacker according to claim 10, wherein a front edge of said top plate is serrated, and further comprising a shutter connected to and movable with said rails in juxtaposition to said front edge.

12. A note stacker for a currency validator, comprising:

first and second oppositely positioned rails, said rails being spaced apart to define a gap, said rails being reciprocatingly movable together and being adapted to receive a note therebetween;

a fixed plate in registration with said gap on a first side of said note when said note is received between said rails;

a movable plate biased toward said rails from a second side of said note when said note is received between said rails; and wherein said fixed plate is arched and has frictional strips along longitudinally extending edges thereof.

13. A note stacker for a currency validator, comprising:

first and second oppositely positioned rails, said rails being spaced apart to define a gap, said rails being reciprocatingly movable together and being adapted to receive a note therebetween;

a fixed plate in registration with said gap on a first side of said note when said note is received between said rails;

a movable plate biased toward said rails from a second side of said note when said note is received between said rails; and wherein said gap reciprocatingly moves as said rails reciprocatingly move, said gap receiving said fixed plate during said reciprocating movement; and each of said first and second rails has a slot therein for receiving said note, and said fixed plate has transport wheels passing therethrough for transporting said note along said slot of said rails.

14. The note stacker according to claim 13, wherein said fixed plate comprises the top of a control housing maintaining therein a first motor for reciprocatingly moving said rails, and a second motor for activating said transport wheels.

15. The note stacker according to claim 14, wherein said rails reciprocatingly move upon respective tracks.

16. The note stacker according to claim 15, wherein said first motor drives wheels pinned to said rails for said reciprocating movement.

* * * * *